US011771207B2

(12) United States Patent
Ressler

(10) Patent No.: US 11,771,207 B2
(45) Date of Patent: Oct. 3, 2023

(54) HAMMOCK WITH AN INTEGRATED INSULATION SECTION

(71) Applicant: Dutch Clips LLC, Reinholds, PA (US)

(72) Inventor: Thomas Ressler, Reinholds, PA (US)

(73) Assignee: Dutch Clips LLC, Reinholds, PA (US)

( * ) Notice: Subject to any disclaimer, the term of this patent is extended or adjusted under 35 U.S.C. 154(b) by 0 days.

(21) Appl. No.: 15/261,184

(22) Filed: Sep. 9, 2016

(65) Prior Publication Data

US 2018/0070707 A1 Mar. 15, 2018

(51) Int. Cl.
*A45F 3/22* (2006.01)

(52) U.S. Cl.
CPC ..... *A45F 3/22* (2013.01)

(58) Field of Classification Search
CPC ..... A47D 15/003; A45F 3/22; A47G 9/08; A61G 7/1023; A47C 27/12
See application file for complete search history.

(56) References Cited

U.S. PATENT DOCUMENTS 1,401,846 A * 12/1921 Wiles ..... A45F 3/22 5/121
1,748,501 A * 2/1930 Stevens ..... A45F 3/22 5/122
1,906,893 A * 5/1933 Young ..... A47C 27/05 5/716
3,675,256 A * 7/1972 Tallarico ..... A45F 3/22 5/120
3,964,113 A * 6/1976 Dean, II ..... A45F 3/22 5/121
4,001,902 A * 1/1977 Hall ..... A45F 3/22 5/121
4,079,568 A * 3/1978 Wortman ..... A41D 31/02 53/432
4,125,909 A * 11/1978 Jacobson ..... A45F 3/22 5/121
5,072,465 A * 12/1991 Lyons, Jr. ..... A47C 17/84 135/90
5,881,409 A * 3/1999 Pearce ..... A43B 5/0405 5/654
8,893,328 B1 11/2014 Kroeger
2003/0028962 A1* 2/2003 Batchelder ..... A45F 3/22 5/120
2006/0185085 A1* 8/2006 Brenner ..... A45F 3/22 5/413 R
2009/0165205 A1 7/2009 Hennessy
2011/0239369 A1 10/2011 Dobin
2012/0260422 A1 10/2012 Rock et al.
2013/0177731 A1* 7/2013 Moriarty ..... B32B 27/12 428/74
2013/0230689 A1 9/2013 Riccelli
2013/0327462 A1 12/2013 Price
2014/0345049 A1* 11/2014 Gash ..... A45F 3/22 5/121

OTHER PUBLICATIONS

Level (definition), Oxford English Dictionary <https://www.oed.com/view/Entry/107654?rskey=3dSK8g&result=2&isAdvanced=false#eid>.*

* cited by examiner

*Primary Examiner* — David R Hare
(74) *Attorney, Agent, or Firm* — Barley Snyder

(57) ABSTRACT

A hammock is provided and includes a bed layer and an insulation section. The insulation section is connected to a bottom surface of the bed layer using a mechanical joint and includes a plurality of baffle boxes containing insulating material.

6 Claims, 8 Drawing Sheets

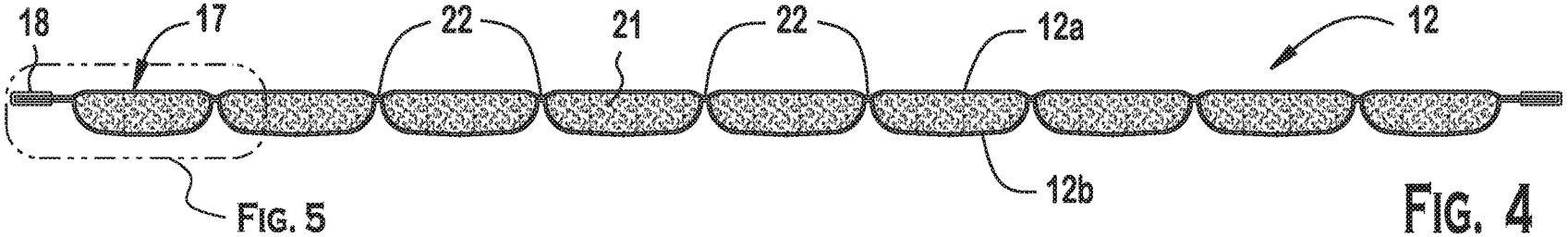
FIG. 4
FIG. 5
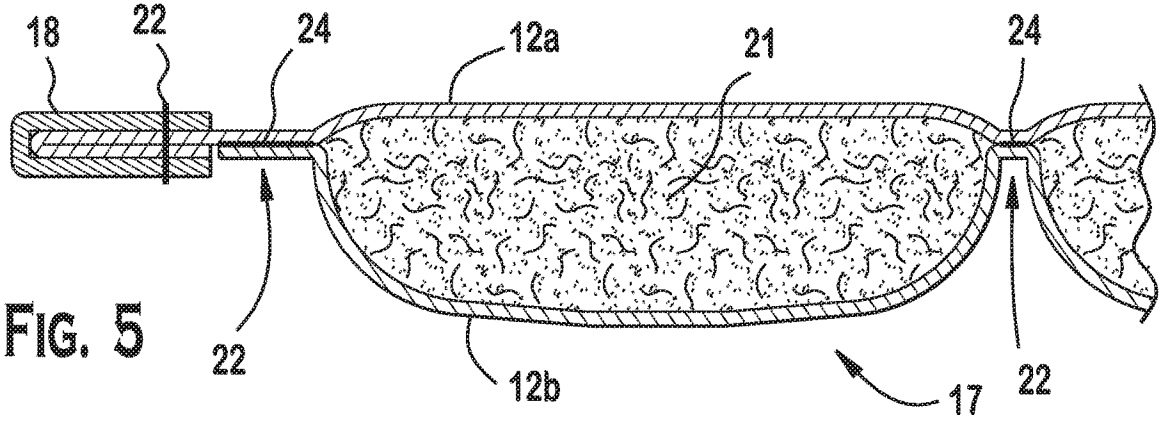
FIG. 5
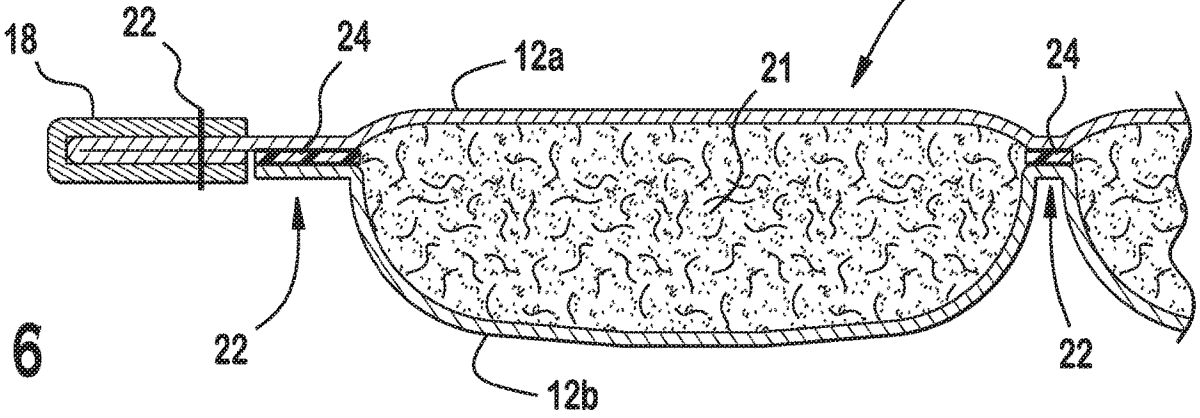
FIG. 6

HAMMOCK WITH AN INTEGRATED INSULATION SECTION

FIELD OF THE INVENTION

This invention relates to a hammock system and, more particularly, to a hammock system having a hammock with an integrated insulation section.

BACKGROUND

Equipment for resting or sleeping comfortably without access to constructed shelters is a challenge faced by recreational campers as well as by professionals such as firefighters, scientific researchers, photographers, wildlife managers, and others who spend extended time in rural or wilderness areas.

Conventional pieces of equipment, specifically hammocks, are deficient in several regards. Foremost is the challenge for a user to retain body heat while suspended in a hammock. Even when ambient temperature of the air is not itself a bodily threat, the effect of wind on the lower surface of an inadequately insulated bed layer can reduce the comfort experienced by the user of a conventional hammock.

Secondly, the weight of any insulation must be balanced with the heat retaining value of that insulation. Furthermore, even where insulation is included, the weight of a user's body (particularly at pressure points such as hips) can compress the loft of insulation thereby reducing the heat-keeping capacity of the insulating element.

Conventional attempts to provide a desirable level of insulation to a hammock include a separate quilted pad. The separate quilted pad adds weight and is an additional item to manage and transport. The separate quilted pad requires some kind of manual attachment or repeated adjustment to the hammock to be functional. A particular attachment system may not complement a particular hammock configuration and may become disconnected or disarrayed in use. Furthermore, a conventional quilted pad is created by means of a line or other fiber stitched through the materials forming the pad.

This conventional technique breaks through the materials and allows heat to pass more readily through the pad, limiting the pad's insulating value.

Therefore, it is desirable to provide a hammock equipped with an integrated insulation section that retains body heat over the heat retaining capacity of an uninsulated hammock, one that provides value to justify the addition of the weight of the insulating element, and one that uses a 'quilting' technique that is especially heat retaining.

SUMMARY

Accordingly, the present invention has been devised in view of the technical problems described above. An object of the present invention, a hammock is provided and includes a bed layer and an insulation section. The insulation section is connected to a bottom surface of the bed layer using a mechanical joint and includes a plurality of baffle boxes containing insulating material.

BRIEF DESCRIPTION OF THE DRAWINGS

The invention will now be described by way of example with reference to the accompanying figures, wherein like reference numerals designate like structural elements, and in which:

FIG. 4 is a cross-sectional view of a baffle box structure of the insulated hammock according to the invention along line 4-4 of FIG. 3;

FIG. 5 is an enlarged view of the portion of FIG. 4 enclosed within a dashed circle showing a baffle box structure;

FIG. 6 is an enlarged view of the portion of FIG. 4 showing a first mechanical joint used for the baffle box structure of the insulated hammock according to the invention;

DETAILED DESCRIPTION OF THE EMBODIMENT(S)

Figure 1:
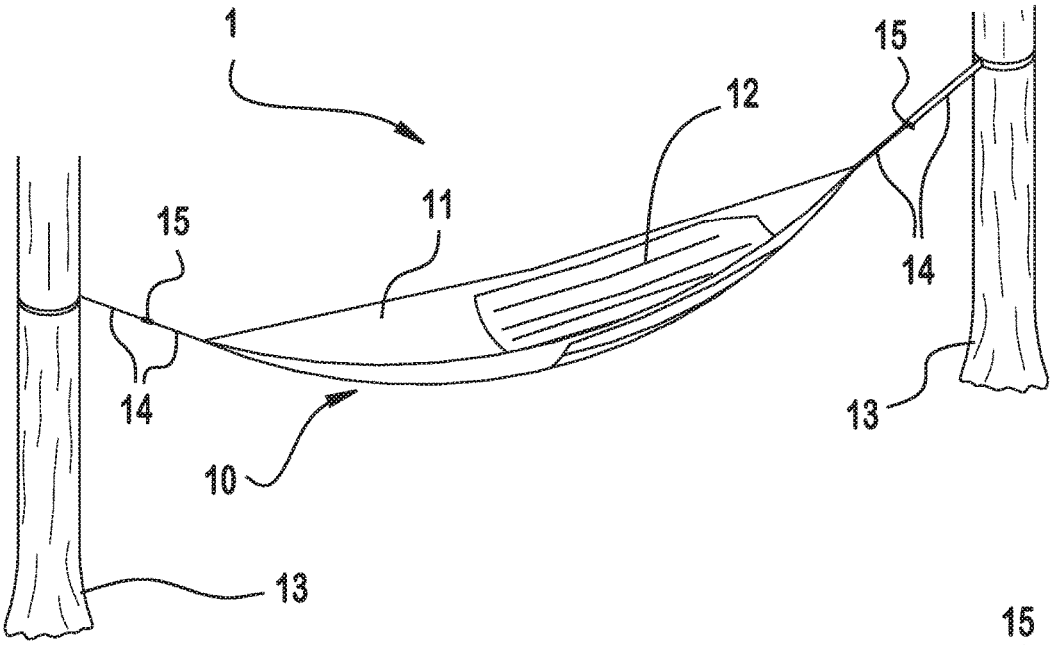
FIG. 1 is a perspective view of an insulated hammock according to the invention.

Referring to FIGS. 1-15, a hammock system 1 according to the invention is shown.

As shown, the hammock system 1 generally includes a hammock 10 having an integrated insulation section 12 according to the invention and tie materials 14 and hardware 15 to suspend the hammock from supports 13.

An exemplary embodiment of the hammock 10 includes the following major components: a bed layer 11 (hereinafter referred to as a "bed") and an integrated insulation section 12 having a plurality of baffle boxes 17 containing insulating material (fill) 21. The baffle boxes 17 are formed between the bed layer 11 and the integrated insulation section 12 using mechanical joints 22 which secure the insulation section 12 to the bed layer 11.

First, with reference to FIG. 1, the hammock 10 is suspended between supports 13 with tie materials 14 and hardware 15.

Figure 2:
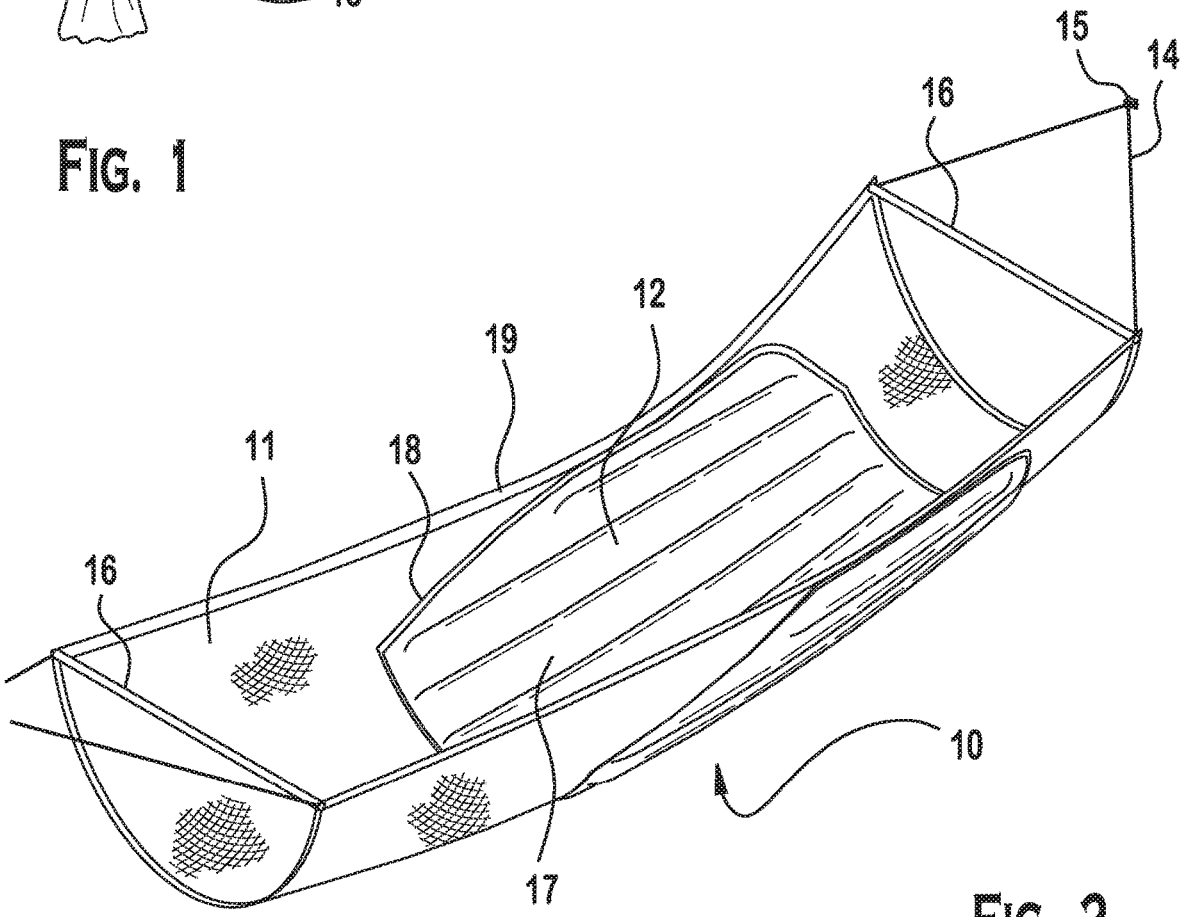
FIG. 2 is another perspective view of the insulated hammock according to the invention showing an integrated insulation section therein.

With reference to FIG. 2, an exemplary embodiment of the suspended hammock 10 is shown. The integrated insulation section 12 is positioned longitudinally between distal and proximal ends of the bed layer 11. The bed 11 is shown as substantially rectilinear and includes an upper surface 11*a* and a lower surface 11*b*. The bed 11 may also be made in a variety of other shapes and sizes: substantially square, rhomboid, ovoid, or elliptical in shape. In one embodiment, the bed layer 11, at proximal end 10*a* and at distal end 10*a*, is held in an expanded position at each end with a first spreader bar 16 and a second spreader bar 16, respectively. The length and width of the bed layer 11 is determined by the size of its intended user. For instance, an adult may require a bed layer 11 of at least 3 feet by 6.5 feet and a child may require a bed layer 11 proportionally reduced in size.

Figure 3:
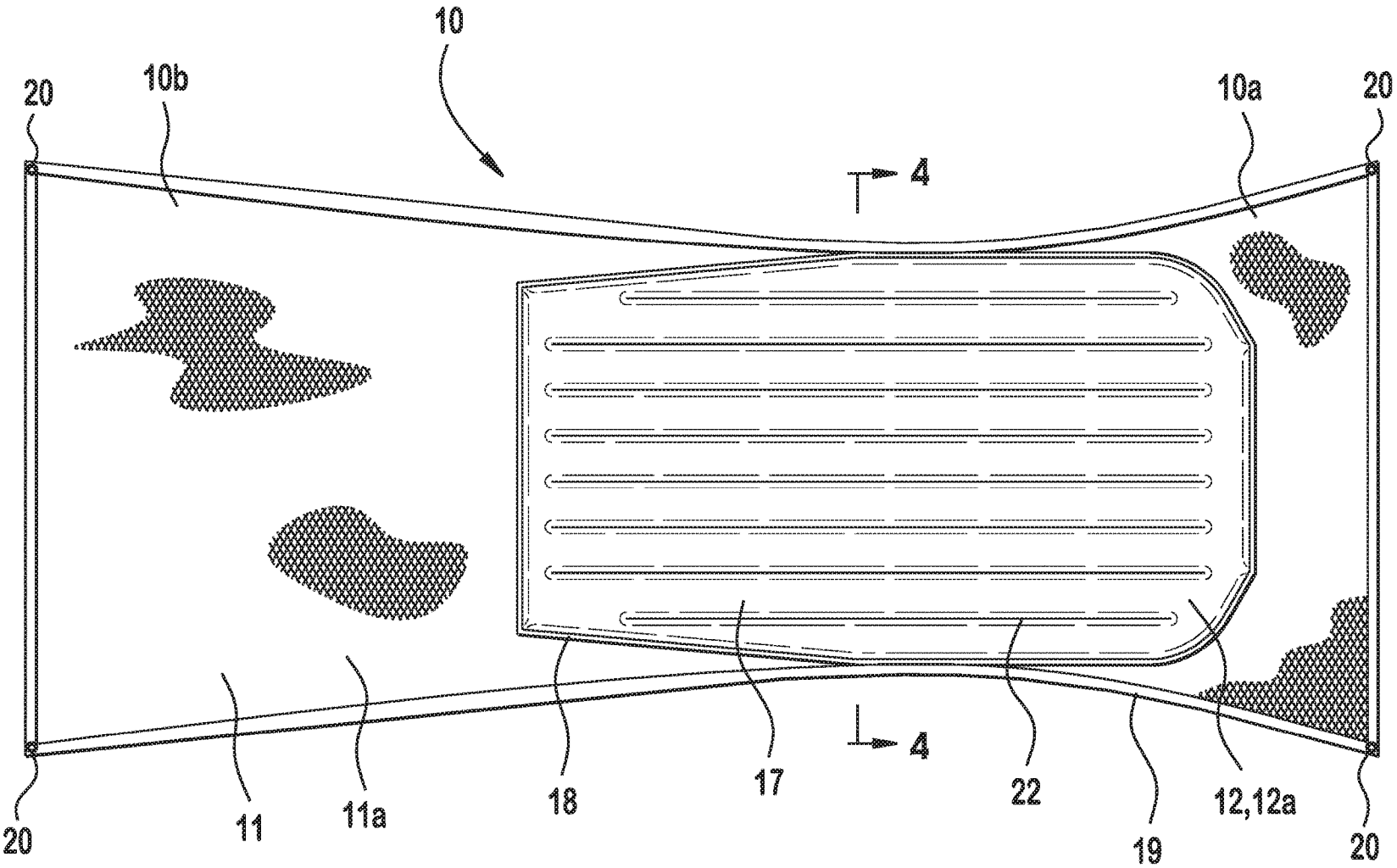
FIG. 3 is a top view of the insulated hammock shown in FIG. 2.
Figure 14:
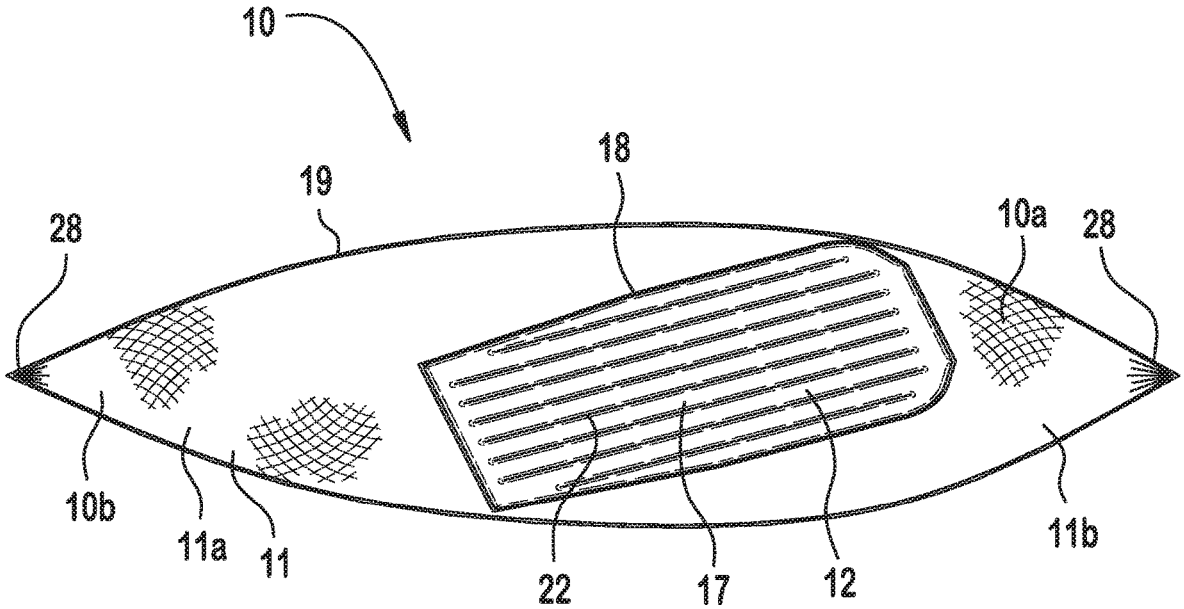
FIG. 14 is a top view of the insulated hammock of FIG. 13.
Figure 15:
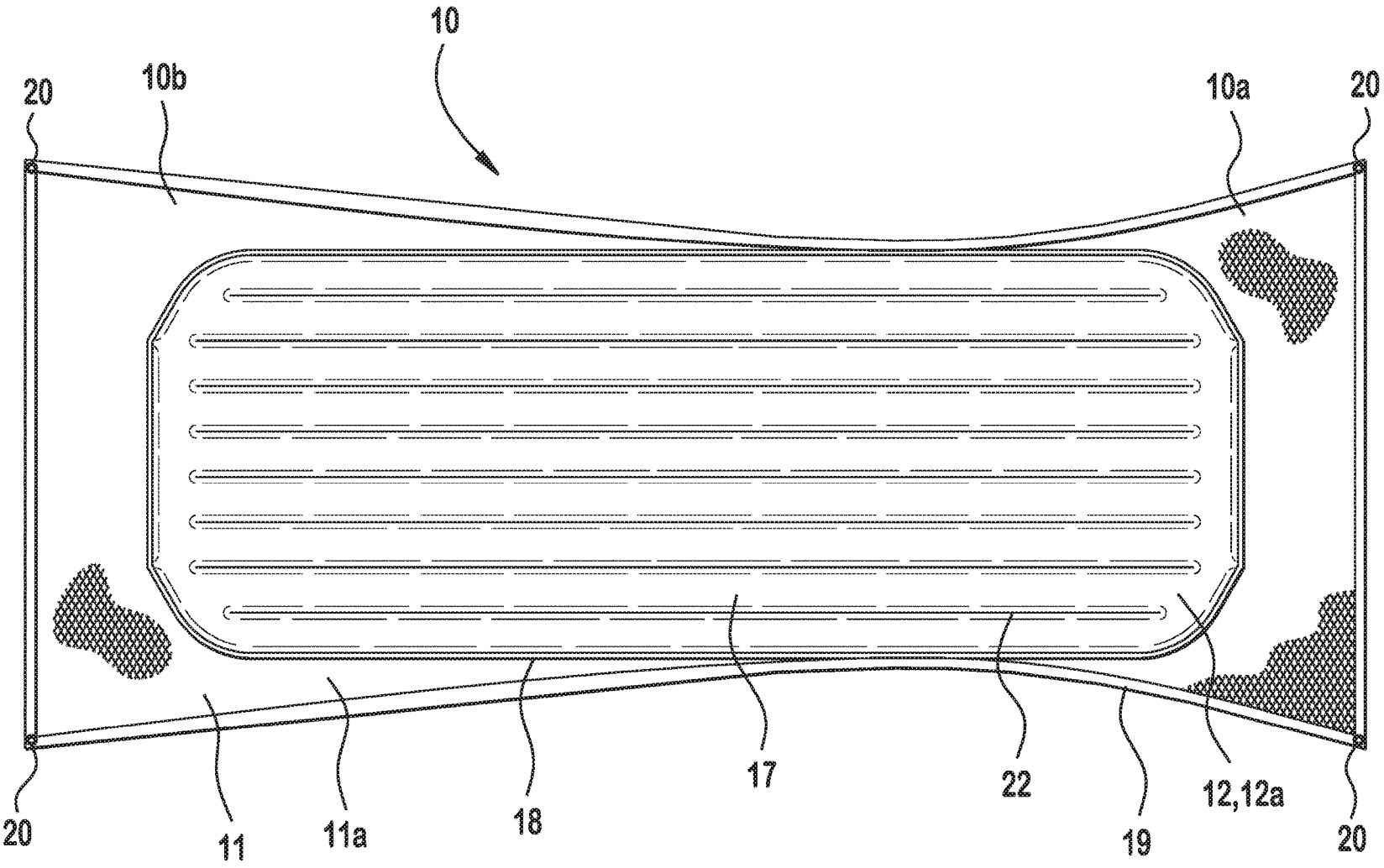
FIG. 15 is a top plan view of another insulated hammock according to the invention.

With reference to FIG. 3, a top view of the hammock 10 is shown. In this and in FIGS. 1-2 and 9-14, the insulation section 12 occupies less than the full area of the bed 11 and is positioned so that the insulation section lies largely towards the proximal end 10*a* of the hammock 10. In FIG. 15, the insulation section 12 occupies nearly the full area of the bed 11. The area occupied by the insulation section 12 according to the invention may vary and is determined by the desired weight and bulkiness of the hammock 10, the weather conditions expected to be encountered, and by the desire to have an insulation section 12 in contact with all or less than all of a user's body. The area occupied by the insulation section 12 may be as little as one third of the area of the bed layer 11. In any case, at a minimum the insulation section 12 preferably should be sized and positioned to be underneath a standard user's head, shoulders, torso, and hips when the hammock 10 is in use.

FIGS. 2-3 and 9-15 show that the outer edge of the bed is finished with a hem or edging 19 to control any tendency of the bed 11 to stretch or of the bed edges to fray or unravel. Each of the corners of the bed 11 is equipped with a grommet 20, a metal ring for lining a hole through which the tie materials 14 to suspend the hammock are threaded.

Referring now to FIGS. 4-8, a plurality of baffle boxes 17 is shown. In this use of the term according to the invention, a baffle box deflects, checks, or regulates the flow or passage of heat. The term "baffle box" includes 1) constructions that are compartments containing insulating fill completely segregated by mechanical joints from the adjacent baffle box and 2) constructions that are compartments containing insulating fill segregated by mechanical joints side-to side on a cross section of the integrated insulation section and open at the head and foot of each baffle box. The depth of the baffle box 17 is selected to reflect the conditions under which the insulated hammock 10 will be used. For example, a deeper baffle box 17 containing a larger amount of fill can provide greater protection from cold conditions by a calculation known to one of ordinary skill in the art. Additionally, the baffle boxes 17 contain the fill 21 in place, reducing the fill 21 from shifting into a less uniform distribution and compromising the ability of the insulated zone 12 to retain heat.

FIG. 4 shows a cross section of the insulation section 12 along line 4-4 of FIG. 3 without indicating a particular embodiment of the mechanical joint 22 that serves to form the baffle box 17. The cross section of FIG. 4 shows the insulation section 12 that is integrated onto the lower (ground-facing) side of the bed layer 11 with a binding 18 and a mechanical joint 22 at the perimeter of the insulation section 12. The baffle boxes 17 are formed between an upper surface 12*a* and a lower surface 12*b* of the insulation section 12 by the use of mechanical joints 22. In one embodiment, the upper surface 12*a* extends beyond the length of the lower surface 12*b* of the insulation section 12 to the extent that it can be folded back upon itself and then enclosed and secured with a mechanical joint within a binding 18. Fill 21 is inserted into the baffle boxes 17 before the entire perimeter of the insulation section 12 is secured to the bed 11 with a mechanical joint 22.

Alternatively, if the choice of insulating materials 21 permit, the upper and lower surfaces 12*a*, 12*b* of the insulation section may be cut and aligned to be of the same length and folded back upon themselves before being enclosed within the binding 18 (not shown). The binding 18 enclosing the folded upper surface 12*a* is secured to the bed layer 11 by mechanical joints 22, preferably to the bed's lower surface 10*b*, as will be explained in greater detail below.

Mechanical joints 22 using hot adhesive or sonic welding are preferred over a stitched ("quilted") joint as the mechanical joint 22 does not penetrate the upper and lower surfaces of the insulation section 12 and thus retains heat to a greater degree than a stitched joint. The particular mechanical joint 22 used to secure the insulation section 12 to the bed layer 11 as well as to form the baffle boxes 17 is selected by one of ordinary skill in the art from various welding techniques. The particular mechanical joint technique is selected following assessment of the materials to be joined and the conditions under which the mechanical joint is created. Use of the mechanical joints securely affixes the insulation section 12 to the bed layer 11. The non-removable construction eliminates the need to adjust or re-secure the insulation section in place during transport or use.

The baffle boxes 17 are packed with a sufficient quantity of insulating fill 21. The particular fill is selected on the basis of cost, weight, and how well the material retains the body heat of the user. One of ordinary skill in the art selects an insulating fill from those known to one of ordinary skill in the art. The fill may be down feathers, synthetic fibers, batting, layers of fabric, or other material that causes body heat from the user to be trapped and retained so that it will not be dissipated and lost. The characteristics of the various insulating fills and the purposes to which the insulating fills will be put are considered in making the choice of materials.

Down may be compressed to a high degree and yet the original loft volume may be maintained over many years. Down that becomes wet does not maintain optimal insulating performance or loft volume. Wet down clumps and balls up and the water adds undesirable weight. Techniques to avoid the negatives of wetted down include weatherproofing the materials forming the baffle boxes or applying a chemical waterproofing treatment to the down itself.

"Fill-power" and "fill-weight" of are elements often used in determining the warmth of a down filled item. The fill-power of various grades of down reflects the volume of cubic inches of one ounce of down that is compressed within a defined space by a standardized weight. The greater the fill-power, the greater is the insulating capacity per unit of down. The fill weight is the amount of down insulation used (often assessed by its thickness). The fill-power and fill weight, among other considerations known to one of ordinary skill in the art, are used to determine the degree of warmth and cost of a particular down-filled item.

Synthetic insulation is composed of plastic spun into fibers that is substituted in items for natural down. Synthetic insulation does not clump or ball up when exposed to water like natural down. The insulating properties of synthetic fibers are less affected by water than those of natural down and will dry out faster, but are still diminished to a degree when wet. A disadvantage to synthetic fibers is that they lose loft and insulating capacity with repeated cycles of compression and expansion.

The bed layer 11 and the upper and lower surfaces 12*a*, 12*b* of the integrated insulation section 12 are composed of flexible materials known to one of skill in the art and suitable for the conditions under which the hammock will be used.

Materials are selected for characteristics that withstand being subjected to water, heat, light, abrasion, and are desirable in light of weight, flexibility, and an ability to be packed easily. Materials suitable for use in the bed layer 11 and insulation section 12 include synthetic (polyester, rip-stop nylon, etc.) or natural fibers (wool, silk, rayon, cotton, etc.), but more preferably include those of light weight, those that are water-, abrasion-, and light-resistant, and those that are of sufficient strength to sustain the load and usage to which the hammock will be subjected to repeatedly.

The binding 18 that encloses the outer perimeter of the insulation section 12 is a material chosen to be compatible with the technique used to attach the insulation section 12 to the bed layer 11. The edging 19 or hemming of the bed layer 11 is a material chosen to be compatible with the stresses it will be subjected to. The joining material 24 is selected to be compatible with the particular mechanical joint 22 chosen for use.

FIG. 5 is an enlarged view of the circled portion of FIG. 4 showing a first embodiment of a mechanical joint 22 according to the invention. Joining material 24 is indicated at locations where hot adhesive or sonic welding is used to fuse the respective layers of materials into a secure attachment.

FIG. 6 is an enlarged view of the circled portion of FIG. 4 showing a second embodiment of a mechanical joint 22 according to the invention. Joining material 24 is indicated at locations where hot adhesive or sonic welding is used to fuse the respective layers of materials into a secure attachment.

Figure 7:
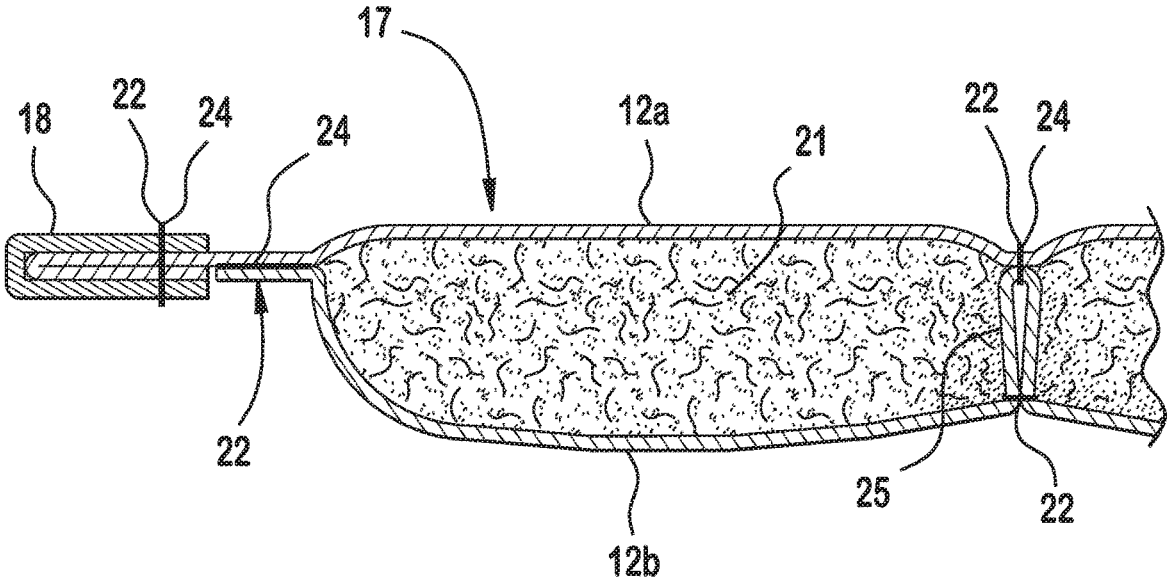
FIG. 7 is an enlarged view of the indicated portion of FIG. 4 showing a second mechanical joint used for the baffle box structure of the insulated hammock according to the invention.

FIG. 7 is an enlarged view of the circled portion of FIG. 4 showing a third embodiment of a mechanical joint 22 according to the invention. In this third embodiment, the lower surface of the baffle box 17 is folded to form a deeper baffle box 17 as compared to the first and second embodiments shown in FIGS. 5 and 6. Hot adhesive or sonic welding is used to secure the mechanical joint 22. Joining material 24 is indicated at locations where hot adhesive or sonic welding is used to fuse the respective layers of materials into a secure attachment.

Figure 8:
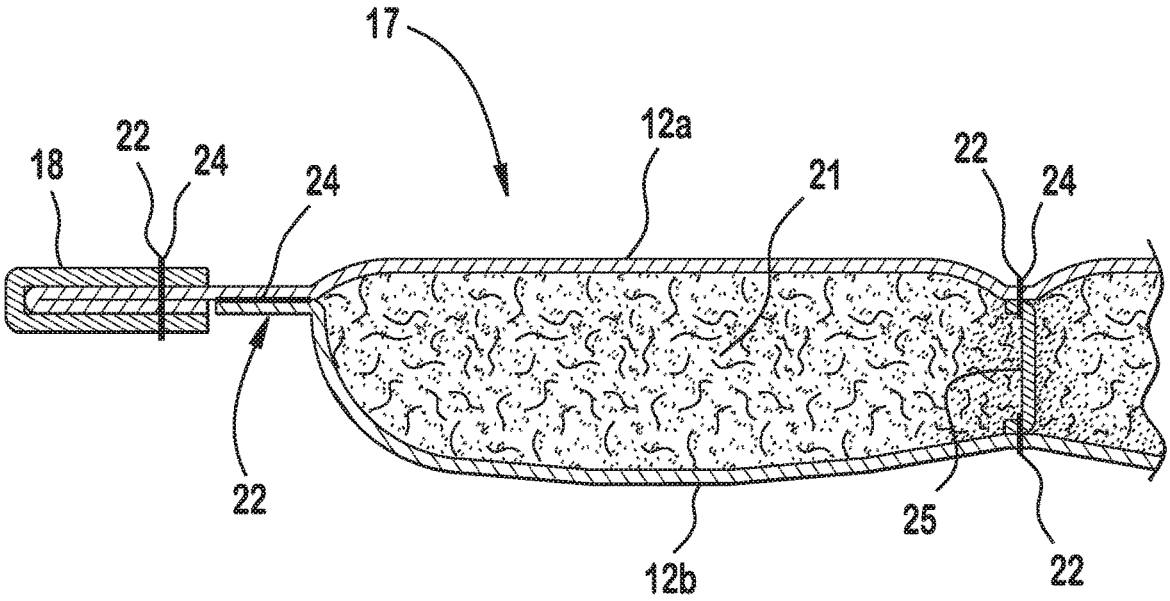
FIG. 8 is an enlarged view of the indicated portion of FIG. 4 showing a third mechanical joint used for the baffle box structure of the insulated hammock according to the invention.

FIG. 8 is an enlarged view of the circled portion of FIG. 4 showing a fourth embodiment of a mechanical joint 22 according to the invention. In this fourth embodiment, the baffle boxes 17 are formed with a partition 25 forming at least one interior wall or barrier dividing the insulating area into separate areas and running longitudinally along the insulation section 12. The partition 25 is secured to the upper and lower surfaces 12*a*, 12*b* of the insulation section 12 with hot adhesive or sonic welding as shown to form the mechanical joint 22. Joining material 24 is indicated at locations where hot adhesive or sonic welding is used to fuse the respective layers of materials into a secure attachment.

In the third and fourth embodiments shown in FIGS. 7 and 8, respectively, the resulting baffle boxes 17 have a substantially uniform depth along the entirety of the insulation section 12 as compared to the first and second embodiments shown in FIGS. 5 and 6 where the mechanical joints 22 do not contain insulating fill 21. The baffle boxes 17 of FIGS. 7 and 8 may both be regarded as using partitions 25 to form the baffle box 17, with the understanding that in FIG. 7 the lower surface 12*b* of the insulation section 12 is used to create the partition 25 and in FIG. 8 an additional material is used to create the partition 25. The result of the constructions of both FIGS. 7 and 8 is to allow a substantially uniform depth of the baffle boxes 17 of the insulation section 12.

With regard to the various mechanical joints 22 shown in FIGS. 5-8, the particular joint used is determined in light of the stresses expected on the joints and the materials used to form the insulation section 12 and the bed layer 11.

Figure 9:
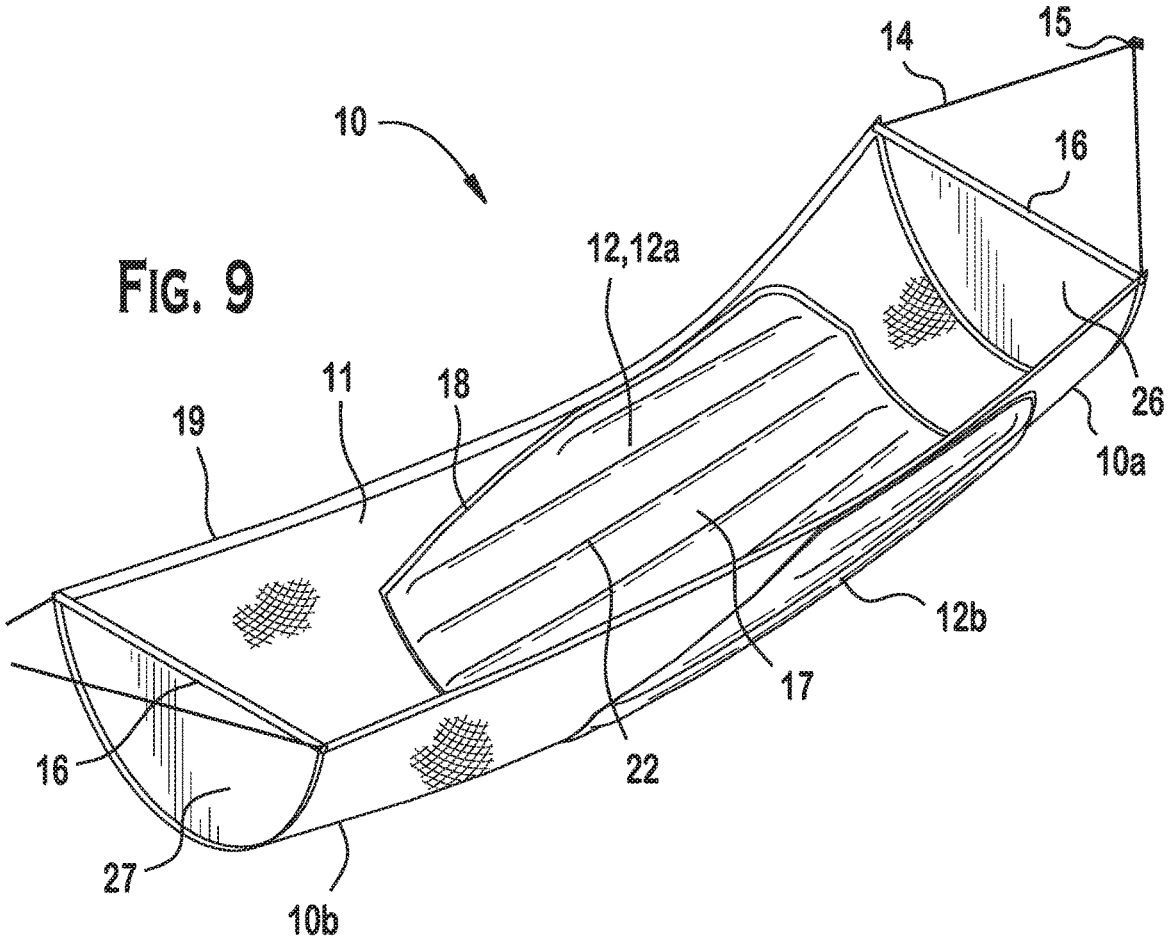
FIG. 9 is another perspective view of the insulated hammock according to the invention, showing use of a spreader bar therewith.

FIG. 9 is an additional view of the hammock 10, the shown embodiment having inserts 26, 27 at the proximal end 10*a* and distal end 10*a* respectively of the bed layer 11. The inserts 26, 27 are useful to contain the user or the user's belongings within the bed of the suspended hammock 10 and may further block the wind.

Figure 10:
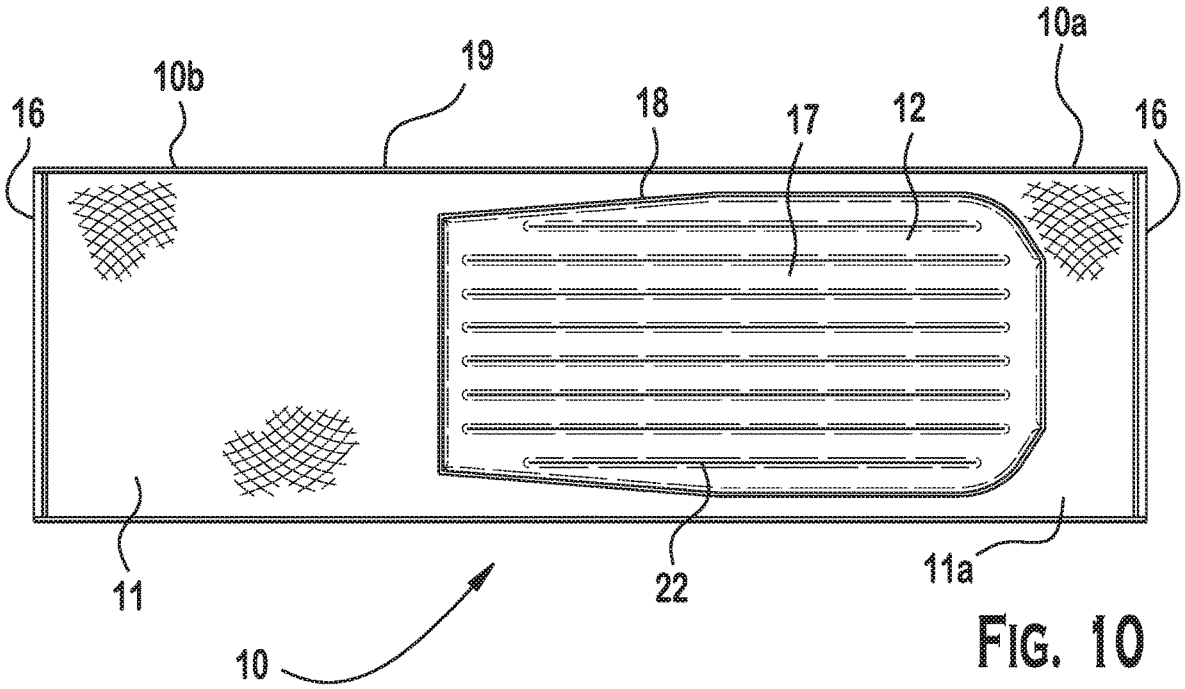
FIG. 10 is a top view of the insulated hammock of FIG. 9.

FIG. 10 shows an overhead view of the hammock 10 shown in FIG. 9. This view shows the bed layer 11, the integrated insulation section 12, and spreader bars 16 attached to the proximal end 10*a* and the distal end 10*a* respectively of the hammock 10.

FIGS. 11-14 show a hammock 10 having the integrated insulation section 12 attached to a bed layer 11 with a gathered attachment point 28. The shown embodiment is in contrast to the prior embodiments which used a spreader bar 16 at the proximal end 10*a* and at the distal end 10*a* of the bed layer 11 to form the attachment points. In the shown embodiment the bed 11 of the hammock 10 is shaped and gathered to form two attachment points instead of four.

Figure 11:
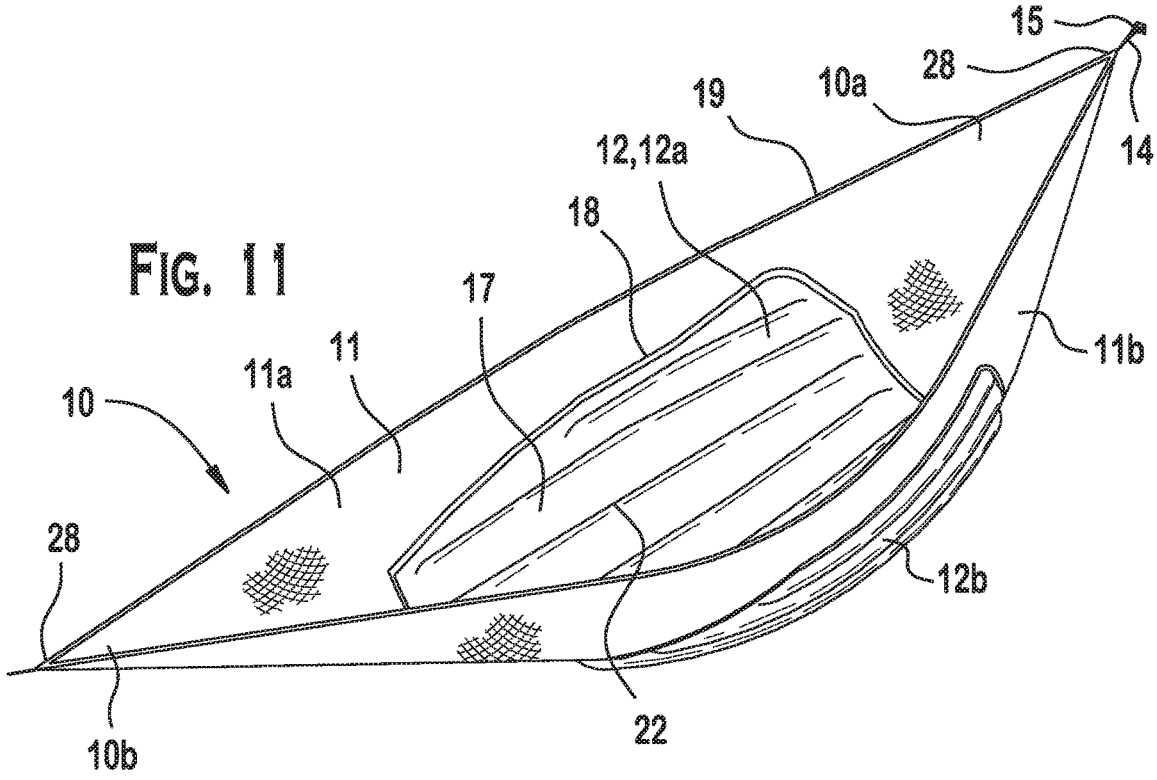
FIG. 11 is a perspective view of another insulated hammock according to the invention.
Figure 12:
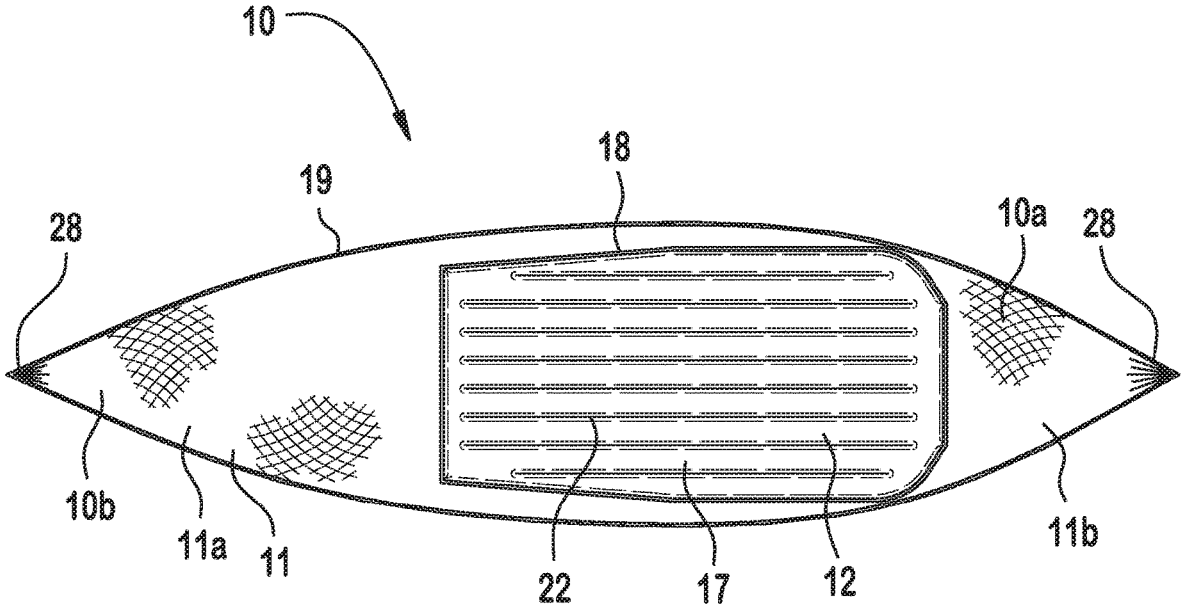
FIG. 12 is a top view of the insulated hammock of FIG. 11.
Figure 13:
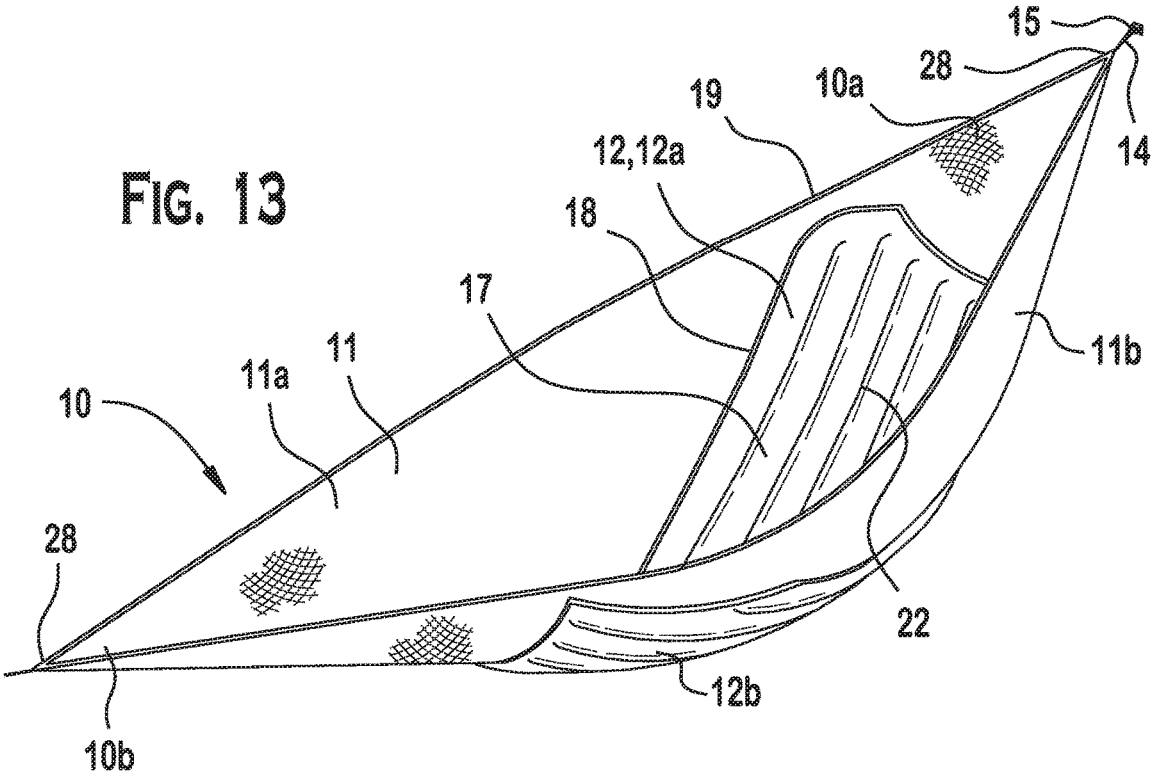
FIG. 13 is a perspective view of another insulated hammock according to the invention.

FIGS. 11 and 12 show the integrated insulation section 12 positioned longitudinally along the bed layer 11 from the proximal end 10*a* to the distal end 10*a*. FIGS. 13 and 14 show the insulation section 12 still running generally from the proximal end 10*a* to the distal end 10*a* of the bed layer 11, but with the integrated insulation section 12 positioned diagonally across the bed layer 11.

FIG. 15 shows an integrated insulation section 12 extended to cover most of the bed layer 11. In contrast to embodiments of the invention shown in FIGS. 1-3 and 9-14, the shown embodiment provides an insulation section 12 beneath the full length of the user, a variant of the invention which may be desirable in certain conditions and temperatures.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A hammock system, comprising a hammock comprising an outer bed layer having an upper layer surface and a lower layer surface; and an insulation section irremovably connected to the lower surface of the outer bed layer and occupying less than the full area of the outer bed layer and is positioned so that the insulation section lies largely towards a proximal end thereof to form a plurality of baffle boxes, the insulation section having an upper section surface and a lower section surface, each baffle box of the plurality of baffle boxes containing insulating material and separated from an adjacent baffle box by a first mechanical joint connecting the lower layer surface and the upper surface section such that a width of the upper surface section is wider than a width of the lower layer surface in each baffle box, the bed layer lower surface joined to the insulation section upper surface by a second mechanical joint along the perimeter of the insulation section, and wherein neither the first mechanical joint nor the second mechanical joint penetrates the bed layer or the insulation section.

2. The hammock system of claim 1, wherein the bed layer is substantially rectilinear.

3. The hammock system of claim 2, wherein the insulation section is substantially rectilinear and oriented longitudinally relative to the bed layer, running from a proximal end towards a distal end of the bed layer.

4. The hammock system of claim 3, wherein the first and second mechanical joints are of hot adhesive or sonic welding.

5. The hammock system of claim 3, wherein each baffle box of the plurality of baffle boxes includes a partition, and wherein each partition is an interior wall or barrier dividing the insulating section into separate areas and running longitudinally or laterally along the insulation section.

6. The hammock system of claim 5, wherein the partition is secured to the upper surface and to the lower surface of the insulation section with a first mechanical joint of hot adhesive or sonic welding.

* * * * *